US011725821B2

(12) United States Patent
Kamoi et al.

(10) Patent No.: US 11,725,821 B2
(45) Date of Patent: Aug. 15, 2023

(54) FUEL NOZZLE DEVICE FOR GAS TURBINE ENGINE

(71) Applicant: HONDA MOTOR CO., LTD., Tokyo (JP)

(72) Inventors: Yasuharu Kamoi, Saitama (JP); Shinichi Kobayashi, Saitama (JP); Hideaki Nakano, Saitama (JP); Yukihito Koizumi, Saitama (JP); Shigeru Hayashi, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 34 days.

(21) Appl. No.: 17/692,273

(22) Filed: Mar. 11, 2022

(65) Prior Publication Data

US 2022/0341595 A1 Oct. 27, 2022

(30) Foreign Application Priority Data

Mar. 26, 2021 (JP) ..... JP2021-053805

(51) Int. Cl.
*F23R 3/28* (2006.01)
*F23R 3/10* (2006.01)

(52) U.S. Cl.
CPC ..... *F23R 3/286* (2013.01); *F23R 3/10* (2013.01)

(58) Field of Classification Search
CPC .... F23R 3/14; F23R 3/28; F23R 3/286; F23R 3/30
See application file for complete search history.

(56) References Cited

U.S. PATENT DOCUMENTS 4,198,815 A * 4/1980 Bobo ..... F23R 3/14 60/737
5,353,599 A * 10/1994 Johnson ..... F23M 5/085 60/39.83
5,987,889 A * 11/1999 Graves ..... F23R 3/14 60/746
6,035,645 A * 3/2000 Bensaadi ..... F23R 3/14 60/742
6,151,899 A * 11/2000 Park ..... F23R 3/343 60/737
6,161,387 A * 12/2000 Green ..... F23R 3/14 60/742

(Continued)

FOREIGN PATENT DOCUMENTS

JP 2009297589 A 12/2009

*Primary Examiner* — William H Rodriguez
(74) *Attorney, Agent, or Firm* — Armstrong Teasdale LLP

(57) ABSTRACT

A fuel nozzle device (100) for injecting liquid fuel into a combustion chamber (52) of a gas turbine engine (10) includes an outer tube (101), a rear end wall (102) closing a base end of the outer tube, a tapered conical tube (104) defining a first air passage (112) therein, and a second air passage (114) having an annular cross section jointly with the outer tube, a fuel passage (108) axially passed through the rear end wall, and leading to a fuel ejection port (109) directed toward an inner circumferential surface of a base end of the conical tube, a first air introduction passage (111) passed through the outer tube to communicate with the first air passage, and a second air introduction passage (113) passed through the outer tube to communicate with the second air passage.

10 Claims, 6 Drawing Sheets

(56) References Cited

U.S. PATENT DOCUMENTS

| | | | | |
|---|---|---|---|---|
| 6,374,615 | B1 * | 4/2002 | Zupanc | F23R 3/343 60/748 |
| 10,634,355 | B2 * | 4/2020 | Prociw | F23R 3/346 |
| 2004/0211186 | A1 * | 10/2004 | Stuttaford | F23R 3/286 60/737 |
| 2011/0296840 | A1 * | 12/2011 | Turrini | F23R 3/12 60/776 |
| 2015/0089952 | A1 * | 4/2015 | Sadasivuni | F23C 7/004 60/737 |
| 2016/0290649 | A1 * | 10/2016 | Prociw | F23R 3/286 |
| 2017/0184309 | A1 * | 6/2017 | Turrini | F23R 3/286 |
| 2018/0172274 | A1 * | 6/2018 | Prociw | F23R 3/10 |
| 2018/0172275 | A1 * | 6/2018 | Prociw | F23R 3/36 |
| 2020/0182466 | A1 * | 6/2020 | Sadasivuni | F23R 3/14 |
| 2020/0191395 | A1 * | 6/2020 | Di Norscia | F23R 3/16 |
| 2020/0248903 | A1 * | 8/2020 | Sampath | F23R 3/14 |
| 2021/0381436 | A1 * | 12/2021 | Matsuyama | F23R 3/343 |
| 2022/0128237 | A1 * | 4/2022 | Ramotowski | F23R 3/14 |

* cited by examiner

FUEL NOZZLE DEVICE FOR GAS TURBINE ENGINE

TECHNICAL FIELD

The present invention relates to a fuel nozzle device for a gas turbine engine.

BACKGROUND ART

In a gas turbine engine, combustion gas for driving the turbine can be obtained by burning an air-fuel mixture formed by injecting fuel such as kerosine into compressed air in a combustor. In this conjunction, in order to achieve efficient combustion, it is desired that the fuel be well atomized or vaporized, or the fuel is well mixed with air.

JP2009-297589A discloses a nozzle device including a central tube for supplying liquid, a conical tube having a base end coaxially surrounding the central tube, and a tapered free end coaxially extending toward the front end thereof, and an outer tube that coaxially surrounding the conical tube. An annular first air passage is defined between the central tube and the conical tube, and an annular second air passage is defined between the conical tube and the outer tube. The two annular air passages are each provided with a constricted section where a high-speed air flow is generated. As a result, a negative pressure is created in these regions so that a jet flow of liquid is ejected from the central cylinder to be mixed with the pressurized air introduced into the first air passage. The flow of the mixture is further accelerated by the pressurized air introduced into the second air passage. Further, swirlers are provided in these air passages so that the high-speed flow of the mixtures forms a swirling flow, and this promotes atomization of the liquid.

However, the nozzle device disclosed in this prior art document relies on the presence of a large pressure difference for creating the high-speed air flow that is required for the atomization of the liquid fuel. In the case of gas turbine engines, the pressure difference between the compressed air chamber and the combustion chamber is so small that a compressed air flow of an adequate speed cannot be obtained. Therefore, this nozzle device is not suitable for use in gas turbine engines.

SUMMARY OF THE INVENTION

In view of such a problem of the prior art, a primary object of the present invention is to provide a fuel nozzle device for a gas turbine engine that can favorably atomize liquid fuel for efficient combustion.

To achieve such an object, the present invention provides a fuel nozzle device (100) for injecting liquid fuel into a combustion chamber (52) of a gas turbine engine (10), comprising: an outer tube (101) extending in an axial direction, and projecting into the combustion chamber; a rear end wall (102) closing a base end of the outer tube; a tapered conical tube (104) extending from an inner periphery of an intermediate part of the outer tube toward a free end of the outer tube in a coaxial relationship, and narrowing toward a free end thereof, the conical tube defining a first air passage (112) therein, and a second air passage (114) having an annular cross section jointly with the outer tube, the first air passage having a first ejection port (118) at a free end of the conical tube, the second air passage having an annular second ejection port (119) surrounding the first ejection port at the free end of the conical tube; a fuel passage (108) axially passed through the rear end wall, and leading to a fuel ejection port (109) directed toward an inner circumferential surface of a base end of the conical tube; a first air introduction passage (111) passed through the outer tube from a part thereof adjacent to the base end of the conical tube to a part thereof adjacent to the fuel ejection port so as to contain a tangential component and communicate with the first air passage; and a second air introduction passage (113) passed through the outer tube in a part thereof adjacent to an intermediate part of the conical tube located between the base end and the free end thereof so as to contain a tangential component and communicate with the second air passage.

Thereby, the liquid fuel and the compressed air can be mixed well so that the combustion efficiency in the combustion chamber can be improved.

Preferably, the rear end wall has a front surface which is flat, and a rear edge of the first air introduction passage substantially aligns with the front surface of the rear end wall.

Thereby, air can be efficiently introduced from the first air introduction passage into a high-speed liquid fuel jet ejected from the liquid fuel ejection port without receiving resistance.

Preferably, an inlet of the first air introduction passage and an inlet of the second air introduction passage are arranged close to each other in the axial direction.

Thereby, the axial length of the fuel nozzle device can be minimized, and the air flow introduced from the air introduction passage can be given with a maximum swirl flow the given axial length.

Preferably, the liquid fuel passage is inclined at a predetermined angle in a circumferential direction.

Thereby, the liquid fuel ejected from the liquid fuel ejection port into the first air passage can be swirled in the same circumferential direction as the swirling direction of the pressurized air introduced from the first air introduction passage. As a result, a film of the liquid fuel adhering to the inner surface of the conical tube can be formed to have a more uniform thickness so that the liquid fuel can be atomized in a favorable manner.

Preferably, the liquid fuel passage is configured so that the liquid fuel is ejected in such a direction as to be impinged upon an inner surface of the conical tube.

Thereby, the liquid fuel that is ejected from the liquid fuel ejection port into the first air passage adheres to the inner surface of the conical tube so as to form a film having a uniform thickness. As a result, the liquid fuel can be atomized in a particularly favorable manner.

Preferably, the outer tube includes a front tube (105) and a rear tube (106) disposed coaxial to each other, and the conical tube is provided with a flange (107) extending radially outward at a rear end thereof, the flange being interposed between the rear end of the front tube and the front end of the rear tube.

Thereby, the fuel nozzle device can be easily assembled.

Preferably, an inlet of the first air introduction passage and an inlet of the second air introduction passage are each provided with a rectangular or oval shape elongated in the axial direction.

Thereby, the opening areas of the inlet of the first air introduction passage and the inlet of the second air introduction passage can be maximized for the given geometry so that the pressure loss in the first air introduction passage and the second air introduction passage can be minimized.

Preferably, the outer tube includes a tapered inner peripheral surface (116) having a progressively increasing diameter toward a front end thereof and extending forward from the second ejection port.

Thereby, the flow ejected from outlet ends of the first ejection port and the second ejection port can be smoothly guided.

Preferably, a part of the outer tube surrounding a front part of the conical tube has a tapered inner peripheral surface (115) that narrows toward the second ejection port.

Thereby, the second air passage narrows toward the front end thereof so that the swirling of the air flow is further enhanced.

Preferably, an inner peripheral part of the outer tube defining the first air introduction passage is provided with a shoulder surface facing forward, and the liquid fuel ejection port opens at the shoulder surface.

Thereby, the structure of the fuel nozzle device can be simplified so that the manufacturing of the fuel nozzle device can be simplified.

The present invention thus provides a fuel nozzle device for a gas turbine engine that can favorably mix liquid fuel with compressed air so that the combustion efficiency in the combustion chamber of the gas turbine engine can be maximized.

BRIEF DESCRIPTION OF THE DRAWING(S)

DESCRIPTION OF THE PREFERRED EMBODIMENT(S)

Figure 1:
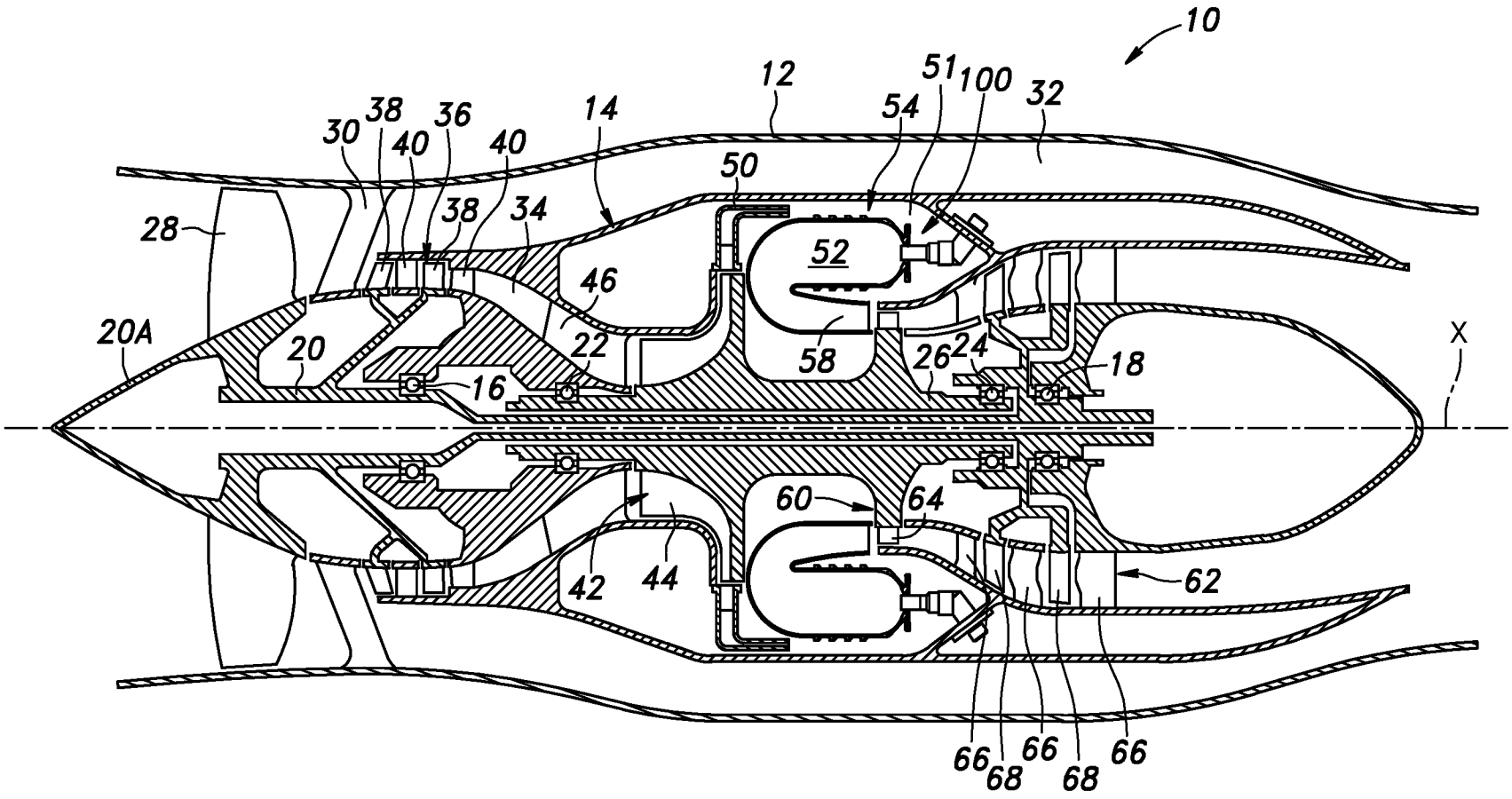
FIG. 1 is a sectional view of a gas turbine engine fitted with a fuel nozzle device for liquid fuel according to an embodiment of the present invention.

A fuel nozzle device 100 for liquid fuel according to an embodiment of the present invention as applied to an aircraft gas turbine engine 10 will be described in the following with reference to the appended drawings. First of all, an outline of the gas turbine engine 10 fitted with the fuel nozzle device 100 of the present embodiment will be described with reference to FIG. 1.

The gas turbine engine 10 has an outer casing 12 and an inner casing 14 both cylindrical in shape and disposed coaxially to each other about a common central axis X. A low-pressure rotary shaft 20 is rotatably supported by the inner casing 14 via a front first bearing 16 and a rear first bearing 18. A high-pressure rotary shaft 26 consisting of a hollow shaft coaxially surrounds the low-pressure rotary shaft 20 about the common central axis X, and is rotatably supported by the inner casing 14 and the low-pressure rotary shaft 20 via a front second bearing 22 and a rear second bearing 24, respectively.

The low-pressure rotary shaft 20 includes a substantially conical tip portion 20A protruding forward from the inner casing 14. A front fan 28 including a plurality of front fan blades is provided on the outer periphery of the tip portion 20A along the circumferential direction. A plurality of stator vanes 30 are arranged on the outer casing 12 on the downstream side of the front fan 28 at regular intervals along the circumferential direction. Downstream of the stator vanes 30, a bypass duct 32 having an annular cross-sectional shape is defined between the outer casing 12 and the inner casing 14 coaxially with the central axis X. An air compression duct 34 having an annular cross-sectional shape is defined centrally in the inner casing 14.

An axial-flow compressor 36 is provided at the inlet end of the air compression duct 34. The axial-flow compressor 36 includes a pair of rotor blade rows 38 provided on the outer periphery of the low-pressure rotary shaft 20 and a pair of stator vane rows 40 provided on the inner casing 14 in an alternating relationship in the axial direction.

An outlet of the air compression duct 34 is provided with a centrifugal compressor 42 which includes an impeller 44 fitted on the outer periphery of the high-pressure rotary shaft 26. At the outlet end of the air compression duct 34 or the upstream end of the impeller 44, a plurality of struts 46 extend radially in the inner casing 14 across the air compression duct 34. A diffuser 50 is provided at the outlet of the centrifugal compressor 42, and is fixed to the inner casing 14.

The downstream end of the diffuser 50 is provided with a combustor 54 for combusting the fuel therein. The combustor 54 includes an annular combustion chamber 52 centered around the central axis X. The compressed air supplied by the diffuser 50 is forwarded to the combustion chamber 52 via a compressed air chamber 51 defined between the outlet end of the diffuser 50 and the combustion chamber 52.

A plurality of fuel injection nozzles 70 for injecting liquid fuel into the combustion chamber 52 are attached to the inner casing 14 at regular intervals along the circumferential direction around the central axis X. Each fuel injection nozzle 70 injects liquid fuel into the combustion chamber 52. In the combustion chamber 52, high-temperature combustion gas is generated by combustion of a mixture of the liquid fuel injected from the liquid fuel injection nozzle 70 and the compressed air supplied from the compressed air chamber 51.

A high-pressure turbine 60 and a low-pressure turbine 62 are provided on the downstream side of the combustion chamber 52. The high-pressure turbine 60 includes a stator vane row 58 fixed to the outlet end of the combustion chamber 52 which is directed rearward, and a rotor blade row 64 fixed to the outer periphery of the high-pressure rotary shaft 26 on the downstream side of the rotor blade row 64. The low-pressure turbine 62 is located on the downstream side of the high-pressure turbine 60, and includes a plurality of stator vane rows 66 fixed to the inner casing 14 and a plurality of rotor blade rows 68 provided on the outer periphery of the low-pressure rotary shaft 20 so as to alternate with the stator vane rows 66 along the axial direction.

When the gas turbine engine 10 is started, the high-pressure rotary shaft 26 is rotationally driven by a starter motor (not shown). When the high-pressure rotary shaft 26 is rotationally driven, compressed air compressed by the centrifugal compressor 42 is supplied to the combustion chamber 52, and the air-liquid fuel mixture burns in the combustion chamber 52 to generate combustion gas. The combustion gas is impinged upon the blades of the rotor blade rows 64 and 68 to rotate the high-pressure rotary shaft 26 and the low-pressure rotary shaft 20. As a result, the front fan 28 rotates, and the axial-flow compressor 36 and the centrifugal compressor 42 are operated, so that compressed air is supplied to the combustion chamber 52, and the gas turbine engine 10 continues to operate even after the starter motor is disengaged.

Further, a part of the air drawn by the front fan 28 during the operation of the gas turbine engine 10 passes through the bypass duct 32 and is ejected to the rear to generate additional thrust. The rest of the air drawn by the front fan 28 is supplied to the combustion chamber 52, and forms a part of fuel mixture jointly with the liquid fuel. The combustion gas generated by the combustion of the mixture drives the low-pressure rotary shaft 20 and the high-pressure rotary shaft 26, and then is ejected rearward to generate a large part of the thrust provided by this gas turbine engine 10.

Figure 2:
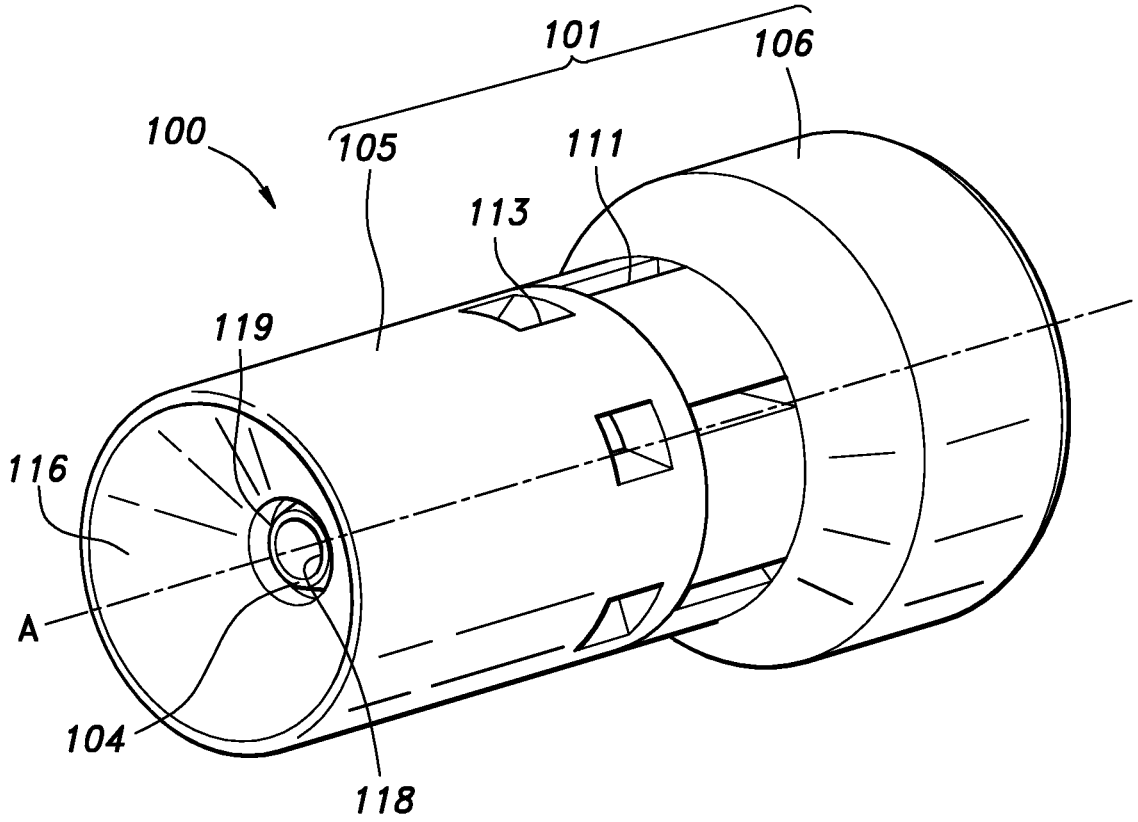
FIG. 2 is a perspective view of the fuel nozzle device.
Figure 3:
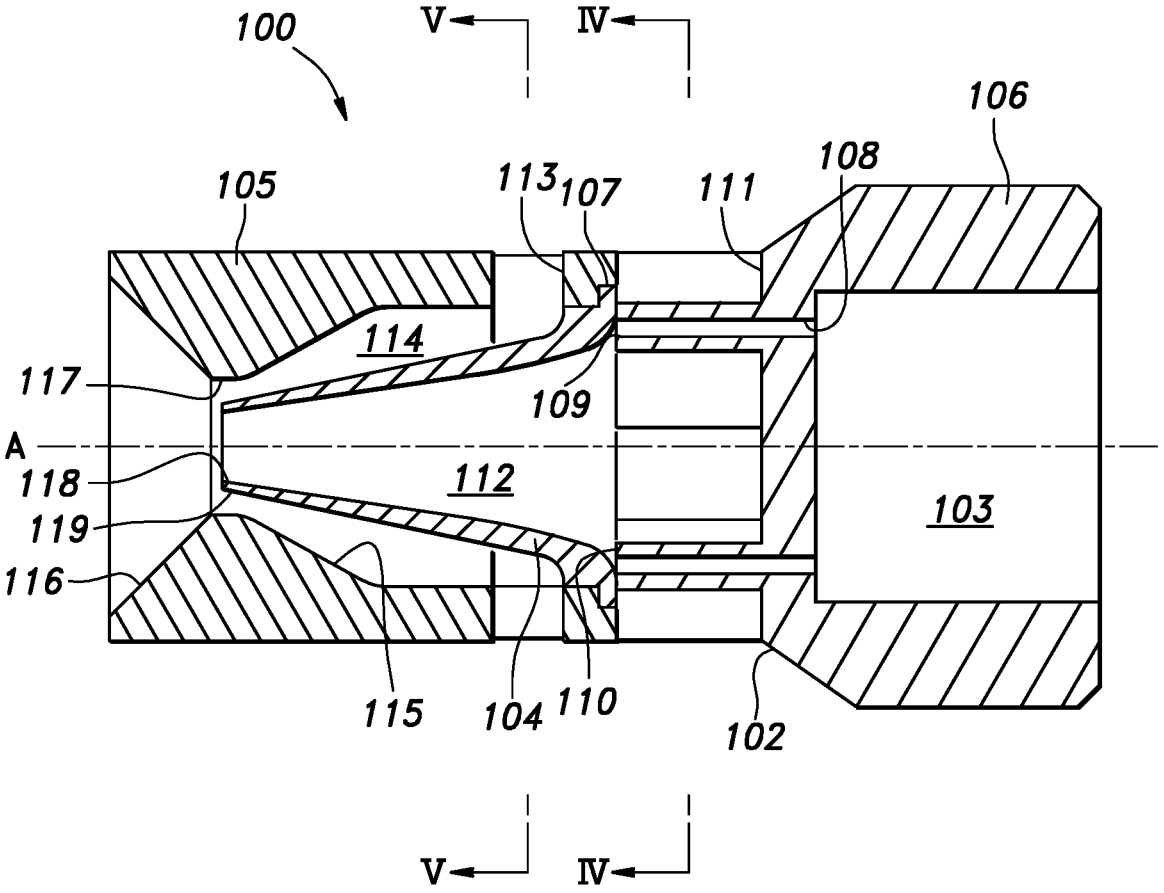
FIG. 3 is a longitudinal sectional view of the fuel nozzle device.

The details of the fuel nozzle device 100 of the present embodiment will be described with reference to FIGS. 2 to 5. FIGS. 2 and 3 show the entire views of the fuel nozzle device 100. The fuel nozzle device 100 includes an outer tube 101 projecting from the rear end of the combustion chamber 52 into the combustion chamber 52. The outer tube 101 extends along a central axis A of its own different from the central axis X of the gas turbine engine 10. The outer tube 101 is provided with a rear end wall 102 which closes the rear end of the outer tube 101 at an axial position slightly recessed from the rear end of the outer tube in the forward direction, and a liquid fuel chamber 103 is defined by the rear surface of the rear end wall 102 and the inner peripheral surface of the outer tube 101. The liquid fuel chamber 103 is a cylindrical chamber coaxially defined within the outer tube 101, and is connected to a liquid fuel pipe (not shown in the drawings) to receive liquid fuel supply.

An inner periphery of an axially intermediate part of the outer tube 101 is connected to a base end (large diameter end) of a conical tube 104 which is coaxial with the outer tube 101 and has a narrowed front end located at a small distance from the front end of the outer tube 101. In the present embodiment, the outer tube 101 is composed of a front tube 105 and a rear tube 106 that are coaxial to each other. A radially outwardly extending flange 107 is provided at the base end of the conical tube 104, and is interposed between the front tube 105 and the rear tube 106. The front tube 105, the rear tube 106, and the flange 107 are joined by welding, brazing or press fitting.

The front tube 105 has a constant outer diameter, and the front end of the rear tube 106 has a substantially same outer diameter as the outer diameter of the front tube 105. The rear end part of the rear tube 106 defining the liquid fuel chamber 103 has a larger outer diameter than the front end part thereof. The front surface of the rear end wall 102 is substantially flat, and corresponds to a region where the outer circumference of the rear tube 106 begins to expand in diameter toward the rear. The inner peripheral surface of the rear tube 106 near the front end thereof is located radially inward of the inner peripheral surface of the rear tube 106 defining the liquid fuel chamber 103.

Six liquid fuel passages 108 are passed axially through the region of the rear end wall 102 adjacent to the outer periphery of the liquid fuel chamber 103 at regular intervals in the circumferential direction. In the present embodiment, the inner circumference of the front end of the rear tube 106 is slightly smaller than the inner circumference of the base end of the conical tube 104 so that an annular shoulder surface 110 facing axially forward is defined at the front end of the rear tube 106 as shown in FIG. 3. Further, the front end of each liquid fuel passage 108 forms a liquid fuel ejection port 109 which opens at the annular shoulder surface 110, and the rear end of each liquid fuel passage 108 communicates with the fuel chamber 103. These liquid fuel ejection ports 109 are arranged near the boundary between the rear end surface of the conical tube 104 facing rearward and the inner peripheral surface forming the conical surface of the conical tube 104. In particular, it is preferable that the extension of each liquid fuel ejection port 109 abuts on the curved surface region connecting the conical surface and the rear end surface of the conical tube 104.

Figure 4:
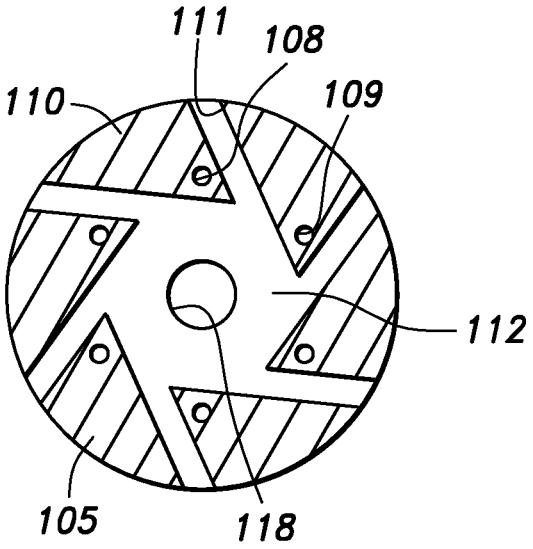
FIG. 4 is a sectional view taken along line Iv-Iv of FIG. 3.

A plurality of first air introduction passages 111 are passed through the wall of a part of the rear tube 106 located between the rear end wall 102 and the base end of the conical tube 104 at regular intervals along the circumference thereof. The first air introduction passages 111 are each provided with an oval or a rectangular cross section that is elongated in the axial direction, and extends along the length thereof so as to be inclined in the tangential direction with respect to the radial direction. The rear edge of the first air introduction passages 111 substantially aligns with the flat front surface of the rear end wall 102. In this embodiment, the rear edge of each first air introduction passage 111 is defined by the flat front surface of the rear end wall 102. As shown in FIG. 4, each liquid fuel passage 108 is located near the inner peripheral surface of the wall of the front end part of the rear tube 106 and between the adjoining first air introduction passages 111. The first air introduction passages 111 communicate with the first air passage 112 defined by the inner peripheral surface of the conical tube 104. In other words, the first air introduction passages 111 directly communicates with the upstream part of the first air passage 112 forming a conical passage defined in front of the rear end wall 102.

Figure 5:
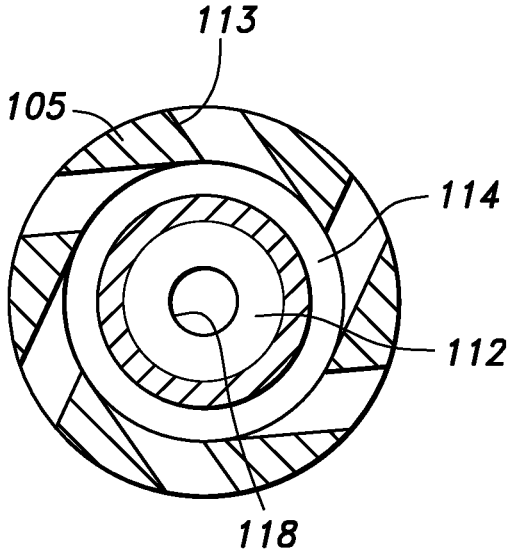
FIG. 5 is a sectional view taken along line V-V of FIG. 3.

A plurality of second air introduction passages 113 are passed through a rear part of the wall of the front tube 105 located immediately in front of the base end of the conical tube 104, and are arranged in the circumferential direction at regular intervals. The second air introduction passages 113 each have a substantially square or otherwise rectangular cross section, and extend so as to be inclined in the same tangential direction as the first air introduction passages 111 with respect to the radial direction. As shown in FIG. 5, the second air introduction passages 113 communicate with a second air passage 114 defined jointly by the outer peripheral surface of the conical tube 104 and the inner peripheral surface of the front tube 105. Further, the inlets of the first air introduction passages 111 and the inlets of the second air introduction passages 113 are arranged close to each other in the axial direction.

The front end of the front tube 105 is located slightly ahead of the front end of the conical tube 104. The inner peripheral surface of the front tube 105 includes a narrowing portion 115 (narrowing toward the front end thereof) located behind the front end of the conical tube 104, a broadening portion 116 (broadening toward the front end thereof) located in front of the front end of the conical tube 104, and a constricted portion 117 located between the narrowing portion 115 and the broadening portion 116 at a position substantially corresponding to the front end of the conical tube 104. Thus, the inner peripheral surface of the front tube 105 coaxially opposes the outer peripheral surface of the conical tube 104. Therefore, the front end of the conical tube 104 defines a first ejection port 118 of the circular first air passage 112, and the part located between the front end of the front tube 105 and the constricted portion 117 defines a second ejection port 119 of the annular second air passage 114.

The mode of operation of the fuel nozzle device 100 will be described in the following. Pressurized liquid fuel is introduced into the liquid fuel chamber 103, and after passing through the liquid fuel passages 108, is injected into the first air passage 112 via the liquid fuel ejection ports 109 as a high-speed jet flow. At this time, a negative pressure is created around the jet of the liquid fuel ejected from the liquid fuel ejection ports 109 so that the compressed air introduced from the compressed air chamber 56 is drawn into the first air passage 112 via the first air introduction passages 111. Since the first air introduction passages 111 are inclined in the tangential direction with respect to the radial direction, the compressed air drawn into the first air passage 112 from the first ejection port 118 forms a swirling flow so that the liquid fuel is favorably atomized, and vaporized. Further, since the first air passage 112 has a tapered conical shape, the swirling speed of the swirling flow increases as the compressed air mixed with liquid fuel travels forward in the first air passage 112 before the swirling flow of the mixture is injected into the combustion chamber 52 via the first ejection port 118. At this time, the flow of the mixture ejected from the first ejection port 118 draws the compressed air introduced into the second air passage 114 via the second air introduction passages 113 from the second ejection port 119. In particular, since the second ejection port 119 is narrower than the upstream side and the downstream side of the second air passage 114, a favorable high-speed flow of compressed air is produced from the second ejection port 119. Further, since the second air introduction passages 113 are inclined in the tangential direction, the compressed air drawn from the second air passage 114 forms a swirling flow and mixes well with the air-liquid fuel mixture ejected from the first ejection port 118.

The front surface of the rear end wall 102 is flat, and substantially aligns with the rear edge of the first air introduction passages 111. As a result, compressed air can be efficiently introduced from the first air introduction passages 111, and ejected toward the high-speed liquid fuel jet which is ejected from the liquid fuel ejection ports 109 without receiving significant resistance.

Further, a significant part of the liquid fuel ejected from each liquid fuel ejection port 109 impinges upon the inner circumferential surface of the conical tube 104. As a result, the liquid fuel adheres to the inner surface or flows along the inner surface of the conical tube 104 so that the atomization and vaporization of the liquid fuel can be promoted.

Further, the first air introduction passages 111 and the second air introduction passages 113 are each provided with a rectangular shape, preferably elongated in the axial direction, so that the cross sectional areas of the first air introduction passages 111 and the second air introduction passages 113 can be maximized so that the amount of compressed air supplied from the compressed air chamber 56 can be increased. Alternatively, the first air introduction passages 111 and the second air introduction passages 113 may be circular or oval in shape, preferably elongated in the axial direction. Further, the first air introduction passages 111 and the second air introduction passages 113 are arranged close to each other in the axial direction so that the axial length of the fuel nozzle device 100 can be minimized, and the flow of compressed air introduced from the first air introduction passages 111 and the second air introduction passages 113 can be tuned into a favorable swirling flow for the given axial length of the fuel nozzle device 100.

Figure 6:
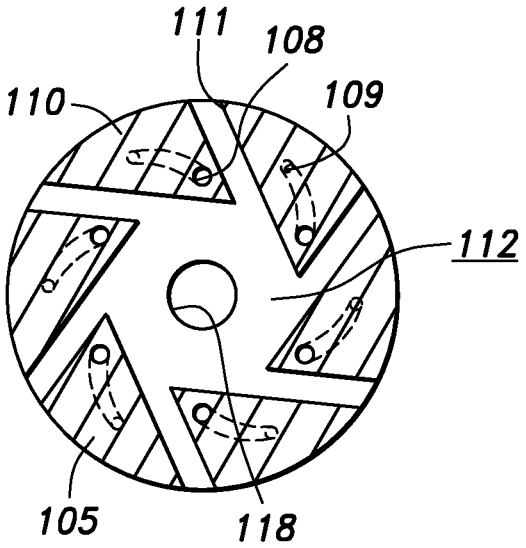
FIG. 6 is a view similar to FIG. 4 showing a fuel nozzle device according to another embodiment of the present invention.

FIG. 6 shows a fuel nozzle device according to another embodiment of the present invention. In this case, each liquid fuel passage 108 is inclined at a predetermined angle in the circumferential direction along the length thereof so that the liquid fuel passage 108 extends along a helical path or along a conical helical path. As a result, the liquid fuel ejected from the liquid fuel ejection ports 109 is given with a velocity containing not only an axial component but also a circumferential component, so that the liquid fuel can be atomized or vaporized in an even more favorable manner.

The present invention has been described in terms of preferred embodiments thereof but is not limited by such embodiments, and can be modified in various ways without departing from the spirit of the present invention. For example, the mutually opposing ends of the front tube 105 and the rear tube 106 forming the outer tube 101 may also be joined to each other by screw thread so as to interpose the flange 107 therebetween. It is also possible to integrally form the conical tube 104 and the rear tube 106, and connect the front tube 105 to the junction between the conical tube 104 and the rear tube 106 by welding, brazing, threading, press fitting or the like.

The invention claimed is:

1. A fuel nozzle device for injecting liquid fuel into a combustion chamber of a gas turbine engine, comprising:

an outer tube extending in an axial direction, and projecting into the combustion chamber;

a rear end wall closing a base end of the outer tube;

a tapered conical tube extending from an inner periphery of an intermediate part of the outer tube toward a free end of the outer tube in a coaxial relationship, and narrowing toward a free end thereof, the conical tube defining a first air passage therein, and a second air passage having an annular cross section jointly with the outer tube, the first air passage having a first ejection port at the free end of the conical tube, the second air passage having an annular second ejection port coaxially surrounding the first ejection port at the free end of the conical tube;

a fuel passage axially passed through the rear end wall, and leading to a fuel ejection port;

a first air introduction passage passed through the outer tube from a part thereof adjacent to a base end of the conical tube to a part thereof adjacent to the fuel ejection port so as to be inclined with respect to a radial direction of the outer tube and communicate with the first air passage; and a second air introduction passage passed through the outer tube in a part thereof adjacent to an intermediate part of the conical tube located between the base end of the conical tube and the free end of the conical tube so as to be inclined with respect to the radial direction of the outer tube and communicate with the second air passage, wherein the fuel ejection port is opened toward an inner circumferential surface of an upstream part of the first air passage, and the first air introduction passage communicates with the upstream part of the first air passage.

2. The fuel nozzle device according to claim 1, wherein the rear end wall has a front surface which is flat, and a rear edge of the first air introduction passage substantially aligns with the front surface of the rear end wall.

3. The fuel nozzle device according to claim 1, wherein an inlet of the first air introduction passage and an inlet of the second air introduction passage are arranged close to each other in the axial direction.

4. The fuel nozzle device according to claim 1, wherein the fuel passage is inclined at a predetermined angle in a circumferential direction.

5. The fuel nozzle device according to claim 1, wherein the fuel passage is configured so that the liquid fuel is ejected in such a direction as to be impinged upon an inner surface of the conical tube.

6. The fuel nozzle device according to claim 1, wherein the outer tube includes a front tube and a rear tube disposed coaxial to each other, and the conical tube is provided with a flange extending radially outward at a rear end thereof, the flange being interposed between a rear end of the front tube and a front end of the rear tube.

7. The fuel nozzle device according to claim 1, wherein an inlet of the first air introduction passage and an inlet of the second air introduction passage are each provided with a rectangular or oval shape elongated in the axial direction.

8. The fuel nozzle device according to claim 1, wherein the outer tube includes a tapered inner peripheral surface having a progressively increasing diameter toward a front end thereof and extending forward from the second ejection port.

9. The fuel nozzle device according to claim 1, wherein a part of the outer tube surrounding a front part of the conical tube has a tapered inner peripheral surface that narrows toward the second ejection port.

10. The fuel nozzle device according to claim 1, wherein an inner peripheral part of the outer tube defining the first air introduction passage is provided with a shoulder surface facing forward, and the fuel ejection port opens at the shoulder surface.

* * * * *